US005775290A

United States Patent [19]

Staerzl et al.

[11] Patent Number: 5,775,290

[45] Date of Patent: Jul. 7, 1998

[54] ENGINE SPEED LIMITER WHICH IS SENSITIVE TO ACCELERATION

[75] Inventors: Richard E. Staerzl, Fond du Lac; Fred M. Hauenstein, Oshkosh, both of Wis.

[73] Assignee: Brunswick Corporation, Lake Forest, Ill.

[21] Appl. No.: 883,497

[22] Filed: Jun. 26, 1997

[51] Int. Cl.[6] ..... F02P 11/02

[52] U.S. Cl. ..... 123/335; 123/198 DC

[58] Field of Search ..... 123/198 D, 198 DB, 123/198 DC, 333, 335

[56] References Cited

U.S. PATENT DOCUMENTS

| | | | |
|---|---|---|---|
| 4,262,641 | 4/1981 | Mosely et al. | 123/335 |
| 4,979,477 | 12/1990 | Nickel et al. | 123/335 |
| 5,138,996 | 8/1992 | Fiorenza, II | 123/335 |

FOREIGN PATENT DOCUMENTS

| | | | |
|---|---|---|---|
| 2027453 | 12/1971 | Germany | 123/335 |

*Primary Examiner*—Tony M. Argenbright

*Attorney, Agent, or Firm*—William D. Lanyi

[57] ABSTRACT

A speed limiting circuit measures the speed of the engine through the use of a device that functions generally as a tachometer. A speed signal is provided and is a function of the frequency of a plurality of pulses provided by a pulse generator. The frequency of the plurality of signal pulses, in a preferred embodiment, is representative of the frequency of a plurality of voltage pulses provided by an ignition coil. Since the voltage pulses from the ignition coil are directly related to the speed of the engine, the speed signal from an integrator can be used as an accurate representation of the engine speed. This speed signal can then be differentiated to determine the acceleration of the engine. The speed signal and acceleration signal are combined by an adder and the combined signal that results is compared to a threshold magnitude. During periods of rapid acceleration of the engine, the ignition system is inhibited at an earlier time than would occur if the speed signal itself was being compared directly to the threshold magnitude. When the propeller of a boat leaves the water, the possibly damaging effects of the resulting acceleration are avoided through the use of the combined signal that adds the acceleration and speed signals together.

18 Claims, 4 Drawing Sheets

ENGINE SPEED LIMITER WHICH IS SENSITIVE TO ACCELERATION

BACKGROUND OF THE INVENTION

1. Field of the Invention

The present invention is generally related to engine controllers or engine speed limiters and, more particularly, to a device which limits the maximum speed of an engine based on a threshold determined as a function of both its speed and acceleration.

2. Description of the Prior Art

In the field of marine engines, one particular problem can occur when a boat leaves the water momentarily during operation. This can occur, for example, when a boat is caused to leap a wave. If the propeller is allowed to leave the water, it is possible that the engine will rapidly accelerate to a speed that is high enough to cause severe damage to the engine. When the propeller leaves the water, the elimination of the normal restriction provided by the water allows the engine to rapidly increase speed and damage the engine.

Certain known engine controllers utilize a fixed threshold magnitude which compares a speed signal to the magnitude and inhibits further acceleration of the engine when the speed signal exceeds the threshold magnitude. In most instances, this type of speed controller is satisfactory. However, it has been determined that when a propeller leaves the water and is momentarily operated in air, the acceleration of the engine is so rapid that by the time the threshold magnitude of velocity is reached and further acceleration is inhibited, even one additional firing of the cylinders of the engine can cause the engine speed to reach damaging magnitudes. In other words, by the time the threshold magnitude of speed is reached and further ignition is stopped, a single additional firing of the ignition system, which is virtually unavoidable, will cause the engine to significantly exceed the threshold magnitude of speed.

It would therefore be significantly beneficial if some means could be provided to anticipate this problem and stop the ignition at a lower speed when the acceleration is relatively high. In other words, the engine speed limiter would apply a lower speed threshold when acceleration is high than the normal speed threshold which is applied when acceleration is low. If this type of engine limiter could be provided, the damaging conditions that arise when a boat jumps a wave and exposes the propeller could be alleviated.

SUMMARY OF THE INVENTION

A preferred embodiment of an engine controller or engine speed limiter made in accordance with the present invention comprises a means for measuring the speed of the engine. This measuring means can comprise a pulse generator which provides a plurality of pulses whose frequency is representative of the speed of the engine. The pulse generator can be associated with an ignition system of the engine. A preferred embodiment of the present invention further comprises a means for determining the acceleration of the engine. This determining means is connected in signal communication with the speed measuring means and can comprise a differentiator circuit which is responsive to the change in the magnitude of a speed signal.

A preferred embodiment of the present invention further comprises a means for combining the speed and the acceleration of the engine in order to form a combined variable which is a function of both the speed and the acceleration. The engine controller also comprises a means for stopping the acceleration of the engine when the combined variable exceeds a preselected threshold magnitude. The stopping means can be a device for inhibiting the ignition coil from providing subsequent energy to the sparkplugs of the engine.

In one particularly preferred embodiment of the present invention, an ignition coil is used to provide a plurality of pulses which are generally representative of the speed of the engine. A pulse generator circuit receives the series of voltage pulses from the ignition coil and provides, as an output, a series of signal pulses which have a frequency which is equal to or representative of the frequency of the voltage pulses. These signal pulses are received by an integrator which integrates them to form a speed signal whose magnitude is representative of the speed of the engine. The speed signal is provided, as an input, to a differentiator which forms an acceleration signal. The speed signal and acceleration signal are added together by an adder circuit and the resulting combined signal is used in a comparison with a preselected threshold magnitude. The combined signal, which is a function of both the speed and acceleration of the engine, is used in the preferred embodiment of the present invention instead of merely using a speed signal for the comparison with the threshold magnitude.

BRIEF DESCRIPTION OF THE DRAWINGS

The present invention will be more fully and completely understood from the reading of the description of the preferred embodiment in conjunction with the drawings, in which.

DESCRIPTION OF THE PREFERRED EMBODIMENT

Figure 1:
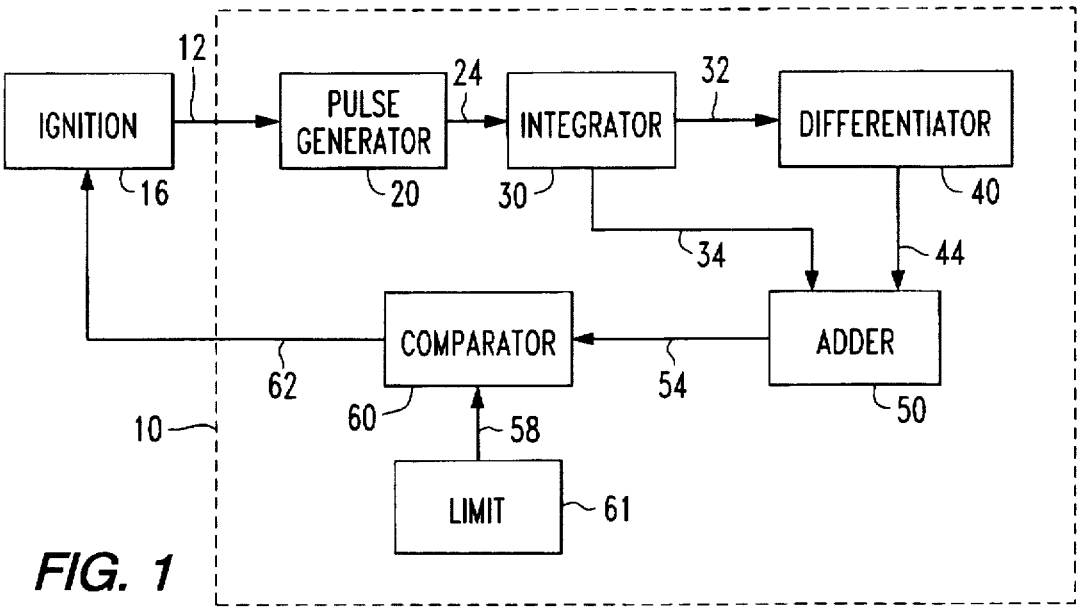
FIG. 1 is a functional block diagram of the present invention.

Throughout the description of the preferred embodiment, like components will be identified by like reference numerals.

FIG. 1 shows a schematic representation of the present invention. The speed limiter 10 is shown surrounded by a dashed line box in FIG. 1. It receives a signal on line 12 from an ignition system 16. The signal on line 12 is typically a voltage pulse, or spike, that is generated at least once for every revolution of a rotor associated with the engine. A preferred embodiment of the present invention comprises a pulse generator 20 which receives the voltage pulses on line 12 from the ignition system 16 and generates a plurality of signal pulses on line 24. The signal pulses on line 24 have a frequency which is equal to, or representative of, the frequency of the voltage pulses received by the pulse generator 20 on line 12 from the ignition system 16.

A plurality of signal pulses on line 24 are received by an integrator 30 which integrates the signal pulses and provides a speed signal on lines 32 and 34. The speed signal on line 32 can be a sawtooth signal having an average magnitude, over time, which is generally representative of the speed of the engine. This speed signal is provided on line 32 to a differentiator 40 which differentiates the signal for the purpose of developing an acceleration signal. The acceleration signal is a function of the rate of change of the speed signal received by the differentiator 40 on line 32. The acceleration signal is provided on line 44 to an adder circuit 50. The adder circuit 50 receives the acceleration signal on line 44 and the speed signal on line 34. These two signals are added together to provide a combined signal on line 54. The combined signal, which is a function of both the speed signal and the acceleration signal, is provided on line 54 to a comparator 60 which compares the combined signal from line 54 with a preselected threshold magnitude received on line 58 from a limit setting device 60. If the combined signal on line 54 exceeds the threshold magnitude on line 58, the comparator provides a signal which inhibits further operation of the ignition system 16. The signal on line 62 from the comparator to the ignition system 16 causes the ignition system to stop providing electrical power to the sparkplugs of the engine. However, as is generally known to those skilled in the art, the nature of an ignition system is that it can provide one additional energization of the sparkplugs of an engine after a signal is sent to it to stop further sparkplug firing. This additional firing of the sparkplugs of a engine, following a determination that some speed related signal has exceeded a limit, can cause severe damage to an engine.

Conventional speed limiting systems compare a speed signal with a threshold magnitude and stop the ignition system when the speed signal exceeds the threshold magnitude. In certain applications, this known technique can be insufficient to preventing damage to the engine. For example, in a marine engine which drives a propeller to propel a boat in the water, the propeller can be caused to leave the water when the boat jumps a wave or, for any other reason, is propelled above the surface of the water. When the propeller is free to spin in air without the restriction provided by water, the rotation of the propeller accelerates rapidly. In fact, the engine is accelerating so rapidly with the propeller out of the water, that each successive firing of a cylinder significantly increases the speed of the engine. In a conventional speed limiting system, where the speed of the engine is simply compared to a threshold magnitude, the stoppage of the ignition system when the speed exceeds the threshold can be too late to prevent damage. Many types of ignition systems have sufficient stored power and sufficient operating speed to cause one subsequent firing of the cylinders even after a stop signal is provided to the ignition system. This one additional firing of the cylinders, with the propeller out of the water, can cause a engine to achieve a speed which is far in excess of the threshold magnitude of speed at which the initial stoppage of the ignition system was initiated.

As shown in FIG. 1, the speed limiter 10 of the present invention uses both the speed signal on line 34 and the acceleration signal on line 44 to generate a combined signal on line 54 which is then compared to a threshold magnitude. This combined signal includes the speed signal and the acceleration signal. If the engine is accelerating rapidly, the combined signal on line 54 is significantly greater than the speed signal on line 34. The increase is caused by the addition of the acceleration signal from line 44. Therefore, rapidly accelerating engines are stopped at a lower actual instantaneous speed than if they were accelerating at a lesser rate. In effect, this creates a variable limit to which the speed is compared, based on the magnitude of acceleration when the comparison is made. In the embodiment of the present invention described immediately above, the threshold magnitude itself is not actually changed but, instead, the combined signal on line 54 is changed. With no acceleration, the combined signal on line 54 is equal to the speed signal on line 34. However, the acceleration signal on line 44 is added to he speed signal from line 34 and the combined signal 54 is used by the comparator 60. The combined signal on line 54 is higher than the actual speed signal. In this way, the present invention accommodates increasing accelerations in the comparison so that the engine damage described above will not occur.

In essence, the present invention anticipates a future speed based on a measurement of the actual speed and a measurement of the acceleration. When the acceleration and the speed, added together, are used in the comparison by the comparator 60, an effective predicted speed when the final firing of the sparkplugs occurs is essentially used to determine an overspeed condition. Then, even if an additional firing of the sparkplugs occurs, the ignition system would have been stopped in time to prevent the overspeed condition that could otherwise destroy or severely damage the engine.

Figure 4:
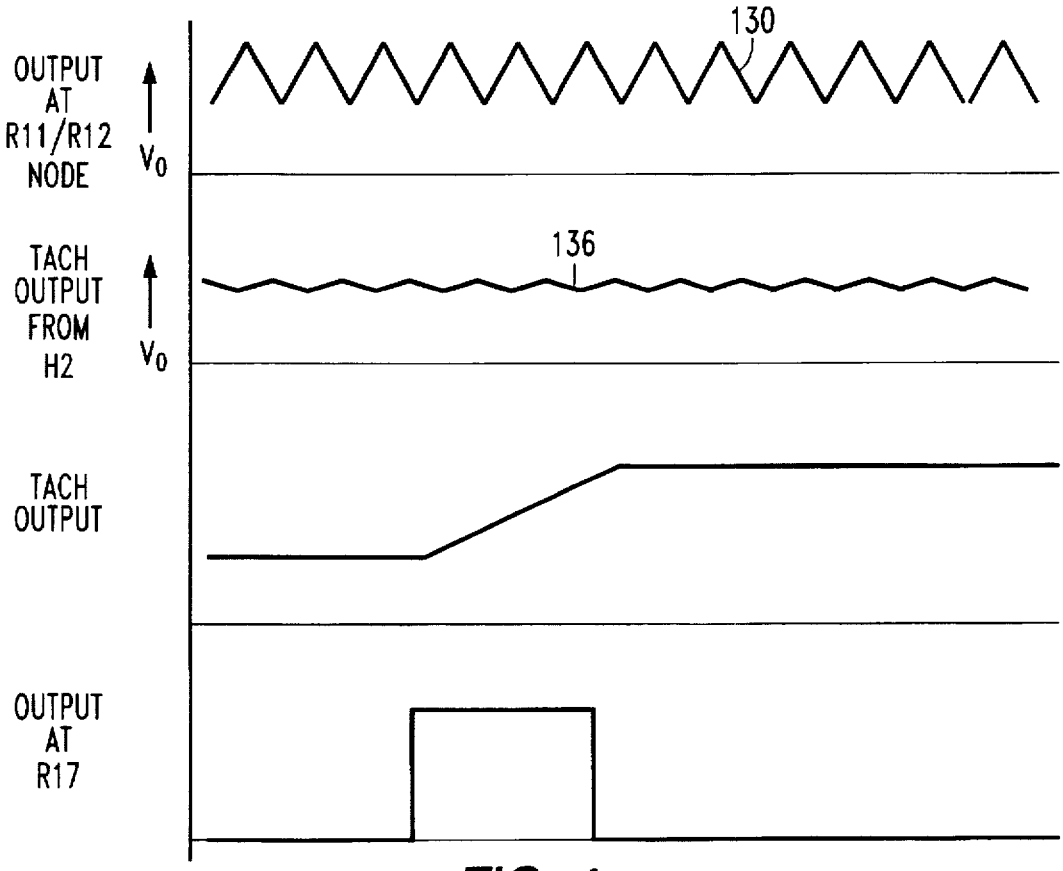
FIGS. 3 and 4 show various wave forms of signals at selected locations in the circuit of FIG. 2.
Figure 2:
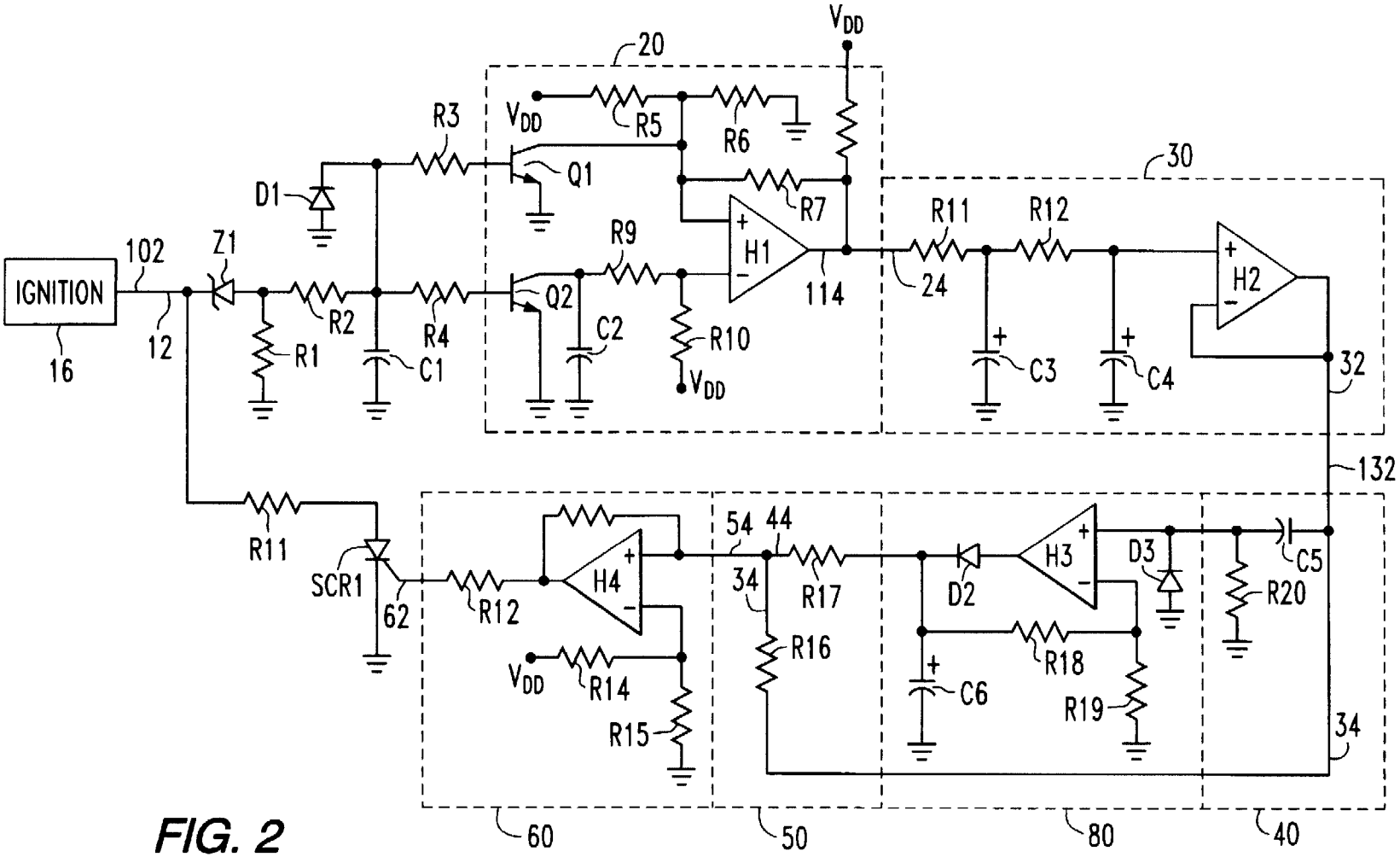
FIG. 2 is an electrical schematic of the present invention shown in FIG. 1.
Figure 3:
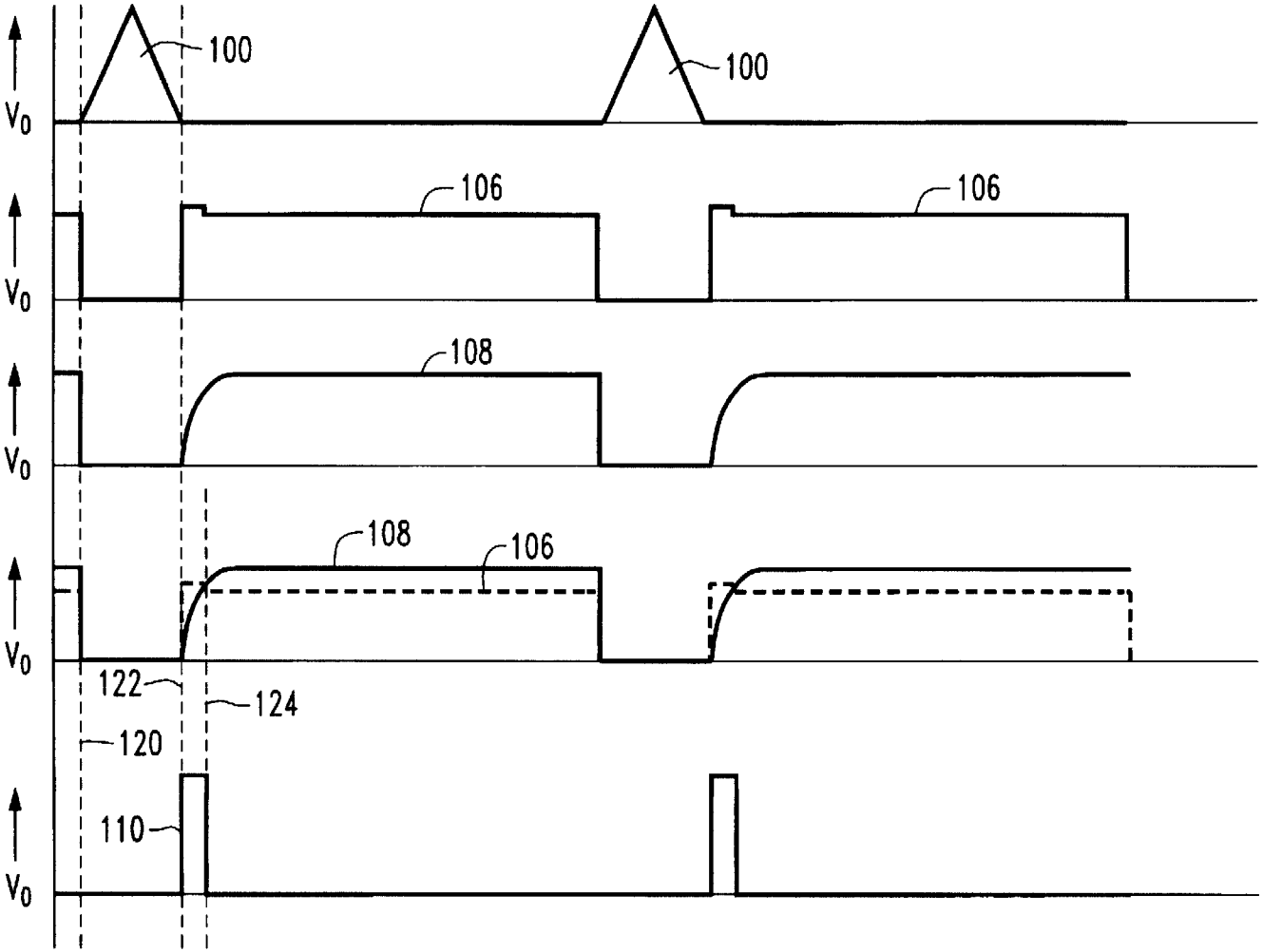

FIG. 2 is a more detailed electrical schematic diagram of one particularly preferred embodiment of the present invention. FIGS. 3 and 4 show various signals that occur at specific locations in the circuit of FIG. 2. The operation of the circuit in FIG. 2 will be described with reference to the signals shown in FIGS. 3 and 4.

With reference to FIGS. 2, 3 and 4, an ignition system 16 provides a plurality of voltage pulses 100 on line 102 in FIG. 2. These voltage pulses 100 can be generated by the stator of an ignition coil. Zener diode Z1 in FIG. 2 limits the voltage seen by the circuit to a preselected magnitude, such as 100 volts. Diode D1 eliminates negative voltage spikes from passing to the pulse generator 20. Capacitor C1 is charged by the positive spikes provided by the ignition system 16 and passing through Zener diode Z1. When a voltage spike at resistor R3 causes NPN transistor Q1 to conduct, the noninverting input of operational amplifier H1 is connected directly to ground potential. When transistor Q1 is not conducting, the noninverting input of operational amplifier H1 is connected to a point between resistors R5 and R6 which holds the signal level at the noninverting input to a preselected magnitude between $V_{DD}$, which is approximate 8.2 volts, and ground potential. Therefore, signal 106 in FIG. 3 represents the change in voltage potential at the noninverting input of operational amplifier H1 with respect to the timing of the voltage pulses 100 received from the ignition system 16.

When a pulse is received at resistor R4, NPN transistor Q2 conducts. With the conduction of transistor Q2, the inverting input of operational amplifier H1 is immediately set to a voltage which is determined by the values of resistors R9 and R10. When transistor Q1 is nonconducting, the inverting input of operational amplifier H1 approaches the magnitude of voltage $V_{DD}$ within a time period determined by the value of capacitor C2. The voltage 108 at the inverting input of operational amplifier H1 is shown in FIG. 3.

In FIG. 3, signals 106 and 108 are shown together in a common timeline to illustrate the changing magnitudes of the inverting and noninverting inputs of operational amplifier H1. The output from amplifier H1 is represented by signal 110 in FIG. 3. Dashed lines 120, 122 and 124 are provided to facilitate the time comparison between the various signals shown in FIG. 3.

With continued reference to FIG. 2, the output signal 110 from the operational amplifier H1 is provided, on line 114, to a multistage integrator. The first stage is provided by resistor R11 and capacitor C3. The second stage is provided by resistor R12 and capacitor C4. The output from these two stages is amplified by operational amplifier H2. The output of the first stage, at the node between resistors R11 and R12 is represented by sawtooth signal 130 in FIG. 4. The output from operational amplifier H2, on line 132, is identified by reference numeral 136 in FIG. 4 and is a speed signal. Although signal 136 appears to show a slight sawtooth shape, its average value over time is representative of the speed of the engine. This speed signal 136 is provided on line 132 to a differentiator 40. The differentiator comprises resistor R20 and capacitor C5. Diode D3 prevents negative signals from damaging amplifier H3. The amplifier circuit 80 comprises amplifier H3, capacitor C6 and resistors R18 and R19. Diode D2 is used for peak detecting in conjunction with capacitor C6. The adder 50 adds the acceleration signal on line 44 to the speed signal on line 34. The sum of thesez two signals is provided to the noninverting input of comparator H4 of the comparator circuit 60. The output from comparator H4 is provided to the silicon control rectifier SCR1 which, when energized, connects line 102 to ground potential through resistor R11.

Table I shows the values of the components in FIG. 2 for one embodiment of the present invention.

TABLE I

| Reference | Value |
|---|---|
| R1 | 10 KΩ |
| R2 | 10 KΩ |
| R3 | 10 KΩ |
| R4 | 10 KΩ |
| R5 | 10 KΩ |
| R6 | 10 KΩ |
| R7 | 1 MΩ |
| R8 | 1 KΩ |
| R9 | 1 KΩ |
| R10 | 100 KΩ |
| R11 | 100 KΩ |
| R12 | 100 KΩ |
| R13 | 1 MΩ |
| R14 | 100 KΩ |
| R15 | 100 KΩ |
| R16 | 10 KΩ |
| R17 | 10 KΩ |
| R18 | 100 KΩ |
| R19 | 100 KΩ |
| R20 | 100 KΩ |
| C1 | .01 μf |
| C2 | .01 μf |
| C3 | .1 μf |
| C4 | .1 μf |
| C5 | 10 μf |
| C6 | 47 μf |
| Z1 | 120 volts |

Figure 5:
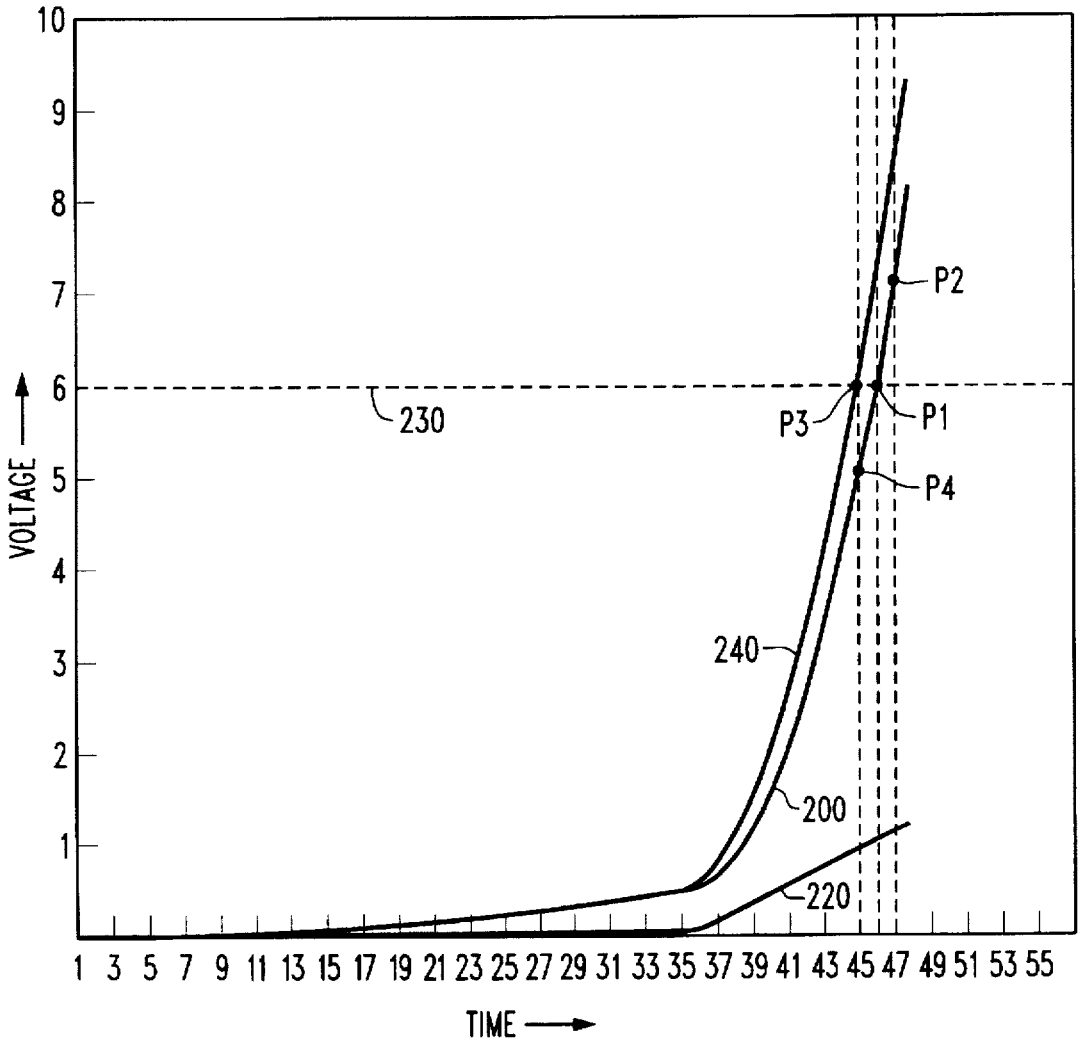
FIG. 5 is a graphical representation of the speed and acceleration of an engine, over time, in addition to the combined signal provided by the present invention.

The advantages of the present invention can be seen in the exemplary and hypothetical representation in FIG. 5. As a function of time, the speed 200 and acceleration 220 are shown. In conventional systems, a signal representing the speed 200 would be compared to a threshold magnitude 230 and, when the speed 200 exceeds the threshold 230, the ignition spark would be inhibited. However, as described above, the nature of many ignition systems is that one additional spark cycle will occur even after the ignition system is turned off. Because of this, a stoppage at point P1 would result in a subsequent increase in the speed 200 to some value, as represented by point P2. It should be understood that the time increments between the various points in FIG. 5 are not intended to be precise but, instead, are intended to be exemplary for purposes of this description. If, on the other hand, a combined signal 240 is used for these purposes, an increase in acceleration 220 added to the speed signal 200 would provide a comparison combined signal 240 that essentially predicts a higher speed at some finite time after the combined signal 240 exceeds the threshold magnitude 230.For example, the combined signal 240 exceeds the threshold magnitude 230 at point P3 when the actual speed 200, without the acceleration added, is still at point P4. The difference in magnitude between points P3 and P4 is equal to the acceleration signal 220. Even if an additional cycle of the ignition system occurs, the subsequent increase in speed would only reach point P1 after one time increment in FIG. 5. Therefore, the increase in speed 200 is held to a lower magnitude than would be possible if only the speed value 200 was used. Naturally, it can be seen that if the acceleration was higher than that shown in FIG. 5, the threshold 230 would be exceeded at an earlier time and the ignition system would be inhibited earlier than that shown in FIG. 5. Therefore, higher magnitudes of acceleration cause the system of the present invention to inhibit the ignition system at an earlier time than would occur if only the speed signal was used.

As a result of the present invention, the rapid acceleration experienced by a marine engine when the boat leaves the water and the propeller is exposed can be prevented from causing damage to the engine. The sudden increase in acceleration that occurs when the propeller is exposed provides a signal which, according to the present invention, is added to the speed signal to form a combined signal 240. It should be understood that the speed signal and the acceleration signal are both increasing at a rapid rate when the propeller leaves the water. Since these two signals are added together by the present invention, an anticipatory inhibition of the ignition system can be used to prevent damage to the engine that could otherwise occur because of the continued spark provided to the cylinders even after the ignition system is initially inhibited.

Although the present invention has been described with particular detail and illustrated to show one specific embodiment of the present invention, it should be understood that other embodiments are also within its scope. For example, with reference to FIG. 1, the functions identified by the functional blocks in the illustration could easily be accomplished through the use of a microprocessor that is appropriately programmed. In other words, the voltage pulse on line 12 could be used to generate input signals which are counted by an integrator in order to integrate the pulses over time. The differentiator function could also be performed by a software sub routine. The calculated results of the integrator 30 and the differentiator 40 could be added together, as is well known to those skilled in the art, to provide a value to the comparator 60 which can be compared to a limit 61. If the combined signal provided by the adder 50 exceeds the limit 61, an output signal from a microprocessor could turn off an ignition system 16. The embodiment shown in FIG. 2 is performed with discrete circuitry. However, as is well known to those skilled in the art, a discrete circuitry can be replaced by an integrated circuit in certain applications. Furthermore, a hybrid circuit could also be used, depending on the intended use of the circuit.

I claim:

1. An engine speed controller, comprising:

means for measuring the speed of an engine;

means, connected in signal communication with said measuring means, for determining the acceleration of said engine;

means for combining the speed and the acceleration of said engine to form a combined variable which is a function of both the speed and the acceleration of said engine; and means for stopping the acceleration of said engine when said combined variable exceeds a preselected threshold magnitude.

2. The controller of claim 1, wherein:

said measuring means comprises a pulse generator which provides a plurality of pulses whose frequency is representative of the speed of said engine.

3. The controller of claim 2, wherein:

said determining means comprises a differentiator.

4. The controller of claim 3, wherein:

said combining means comprises an adder which adds a speed signal from said measuring means with an acceleration from said determining means.

5. The controller of claim 4, wherein:

said stopping means comprises a device for inhibiting an ignition coil from providing electrical power to one or more spark plugs of said engine.

6. A speed limiter for an engine, comprising:

a signal generator connected to said engine, said signal generator providing a plurality of signal pulses at a frequency which is representative of the speed of said engine;

an integrator for integrating said plurality of signal pulses and providing a speed signal which is representative of said speed of said engine;

a differentiator which receives said speed signal and provides an acceleration signal representative of the rate of acceleration of said engine;

an adder for adding said speed signal to said acceleration signal to form a combined signal;

a comparator which compares said combined signal to a preselected threshold magnitude and stops the acceleration of said engine when said combined signal is greater than said threshold magnitude.

7. The limiter of claim 6, wherein:

said signal generator comprises an igniter for generating a first plurality of voltage pulses at a frequency which is representative of the speed of said engine and a pulse generator for providing said plurality of signal pulses at a frequency which is representative of said frequency of said plurality of voltage pulses.

8. The limiter of claim 7, wherein:

said integrator comprises a plurality of discrete circuit components.

9. The limiter of claim 7, wherein:

said integrator comprises a routine in a microprocessor.

10. The limiter of claim 6, wherein:

said integrator, said differentiator and said adder comprise discrete circuit components.

11. The limiter of claim 6, wherein:

said integrator, said differentiator and said adder comprise routines of a microprocessor.

12. A speed limiter for an engine, comprising:

a signal generator connected to said engine, said signal generator providing a plurality of signal pulses at a frequency which is representative of the speed of said engine, said signal generator comprising an igniter for generating a first plurality of voltage pulses at a frequency which is representative of the speed of said engine and a pulse generator for providing said plurality of signal pulses at a frequency which is representative of said frequency of said plurality of voltage pulses;

an integrator for integrating said plurality of signal pulses and providing a speed signal which is representative of said speed of said engine;

a differentiator which receives said speed signal and provides an acceleration signal representative of the rate of acceleration of said engine;

an adder for adding said speed signal to said acceleration signal to form a combined signal;

a comparator which compares said combined signal to a preselected threshold magnitude and stops the acceleration of said engine when said combined signal is greater than said threshold magnitude.

13. The limiter of claim 12, wherein:

said integrator comprises a plurality of discrete circuit components.

14. The limiter of claim 12, wherein:

said integrator comprises a routine in a microprocessor.

15. The limiter of claim 12, wherein:

said integrator, said differentiator and said adder comprise discrete circuit components.

16. The limiter of claim 12, wherein:

said integrator, said differentiator and said adder comprise routines of a microprocessor.

17. The limiter of claim 12, wherein:

said engine is a marine engine.

18. The limiter of claim 17, further comprising:

a drive shaft connected to said engine; and a propeller connected to said drive shaft.

* * * * *